United States Patent [19]

Glass

[11] 4,190,309

[45] Feb. 26, 1980

[54] TRACK LIGHT

[76] Inventor: Irving J. Glass, 64-85 Wetherole St., Forest Hills, N.Y. 11374

[21] Appl. No.: 928,443

[22] Filed: Jul. 27, 1978

[51] Int. Cl.[2] ..... H01R 9/00; H01R 13/60

[52] U.S. Cl. ..... 339/21 R

[58] Field of Search ..... 339/20, 21 R, 21 S, 339/22 R, 22 B, 22 T

[56] References Cited

U.S. PATENT DOCUMENTS

| | | | |
|---|---|---|---|
| 2,981,917 | 4/1961 | Glass | 339/9 R |
| 3,596,226 | 7/1971 | Meltzer | 339/22 B |

*Primary Examiner*—Neil Abrams

*Attorney, Agent, or Firm*—Richard L. Miller

[57] ABSTRACT

A lighting fixture which is adjustably positioned along a track and which permits simplified adjustment along the track as well as facilitating installation and removal from the track. The track is an elongated housing with a T-shaped channel formed in the housing and a pair of parallel conductor strips embedded into a portion of the channel. The adjustable lighting fixture includes a contacting member which can be inserted into the track and rotated in the channel. A pair of conical contacts are contained on the contacting member for contacting the conductor strips in the channel. A threaded post extends from the contacting member and wires extend from the contact through the post for connection to a lighting device. A cover is axially movable long the post and is axially moved along the post by means of a cap which threads onto the post. The cover includes a locking arrangement for preventing rotation of the fixture in the track once it is installed.

8 Claims, 5 Drawing Figures

TRACK LIGHT

BACKGROUND OF THE INVENTION

This invention relates to lighting fixtures and more particularly to an improved adjustable track light.

In recent years there has been a growing demand for electrical lighting fixtures which are not permanently positioned but can be adjustably manipulated into a variety of positions. One solution for providing such flexibility of the location of the lighting fixtures is to provide a track light. Such track light includes an elongated track which is mounted onto a support surface such as a wall or a ceiling. A lighting fixture extends from the track and can be adjustably positioned along the track. In this manner, the lighting fixture can be repositioned as desired at any convenient location along the length of the track.

One problem with utilizing conventional track lighting fixtures concerns the arrangement for adjustably repositioning the fixture along the track. In many types of lighting fixtures a complex clamping arrangement is utilized which requires difficult manipulations in readjusting the positioning of the lighting fixtures. Other conventional arrangements may provide for a simplified adjustment along the track but necessitates inconvenient installation of the lighting fixture into the track upon initial assembly. Yet other conventional track lights are further complicated by means of the electric wires which slide through the track and often hang from the track making an unsightly fixture.

There is accordingly a need for a track light which can provide for simplified installation and removal of the lighting fixture from the track and at the same time provide simplified adjustability of the fixture along the length of the track.

In my previous U.S. Pat. No. 2,981,917, issued Apr. 25, 1961, for "Adjustable Electric Fixture", I had described an electrical fixture which mounts electric lamps in a manner that permits vertical adjustment of the lamp along a tubular member. The particular electrical fixture had a unique arrangement which would match the tubular lamp support and a particular fixture assembly which was of specific unique benefits to vertical adjustment along a tubular lamp support. Nevertheless, some of the features included in my previous patent find application as well in track lighting. However, prior to utilization of those features, specific problems associated with track lighting must first be recognized and appropriate modification of those features is necessary in order to accommodate those benefits to track lighting fixtures.

SUMMARY OF THE INVENTION

It is accordingly an object of the present invention to provide an improved track lighting electrical fixture.

Yet a further object of the present invention is to provide an adjustable lighting fixture utilized in conjunction with a track.

A further object of the present invention is to provide a track light having an adjustable lighting fixture which can be easily inserted and removed from the track.

Still another object of the present invention is to provide an improved track light having an adjustable lighting fixture which can be easily moved from one position to another along a track.

A further object of the present invention is to provide an improved track light which avoids the necessity of having wires freely running through the track.

Still another object of the present invention is to provide an improved track light which permits easy manipulation and facilitates adjustability of a lighting fixture along a track.

A further object of the present invention is to provide an improved track light having a coupling member which can be easily inserted into the track light and easily locked in place at a desired position along a track.

Yet, a further object of the present invention is to provide an improved track light characterized by its low cost, simplicity, ruggedness, ease of use and application, as well as its safety and absence of shock hazards.

The invention comprises a track light including the combination of a track with an adjustable lighting fixture. The track includes an elongated housing which can be mounted onto a support surface. A T-shaped channel is formed in the housing which channel includes a transverse slot having a lower wall and an open groove formed in the lower wall. A pair of laterally spaced, parallel conductor strips are partially imbedded into the lower wall on opposite sides of the groove. Inwardly turned shoulders are formed in the lower wall and overhang the edges of the conductor strips.

The adjustable lighting fixture includes a contacting member which has a hollow post that is externally threaded on at least a portion thereof. A cross bar is connected across one end of the post and has a length which is less than the width of the channel, and has a width which is less than the width of the groove. A pair of mutually insulated conical contacts depend from the cross bar and are laterally spaced on either side of the post. The contacts can separably engage a respective conductor strip. An axial collar is positioned along the post in a spaced relationship from the cross bar with an axial keyway formed in the collar. A T-shaped cover member is mounted onto the post. The cover member includes a transverse plate with a cylindrical body depending therefrom. An inwardly turned radial flange is formed at the lower end of the cylindrical body and defines a central opening through which the shaft can extend. An axial keyway inwardly extends from the cylindrical body and mates with the keyway on the collar to provide non-rotative engagement between the cover member and the contacting member. Locking pads upwardly extend from the transverse plate and are laterally positioned with respect to the cylindrical body. The locking pads can extend into the groove to prevent rotation of the T-shaped cover member with respect to the track. A threaded cap member threads onto the post axially outward of the cover member and provides axial movement of the cover member along the post. A spring is spacedly positioned around the post and is within the cylindrical body. The spring extends between the collar and the flange and biases the cover member away from the cross bar.

The cross bar can be inserted through the groove of the track and then upon rotation it is positioned transversely across the track. The cap member can then be tightened onto the post which moves the cover member axially along the post until the locking pads are inserted into the groove and the conical contacts firmly contact the conductor strips. Wires from the conical contacts extends downwardly through the post and can be electrically connected to a lamp connected onto the post.

The aforementioned objects, features and advantages of the invention will, in part, be pointed out with particularity and will, in part, become obvious from the following more detailed description of the invention, taken in conjunction with the accompanying drawing, which forms in integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
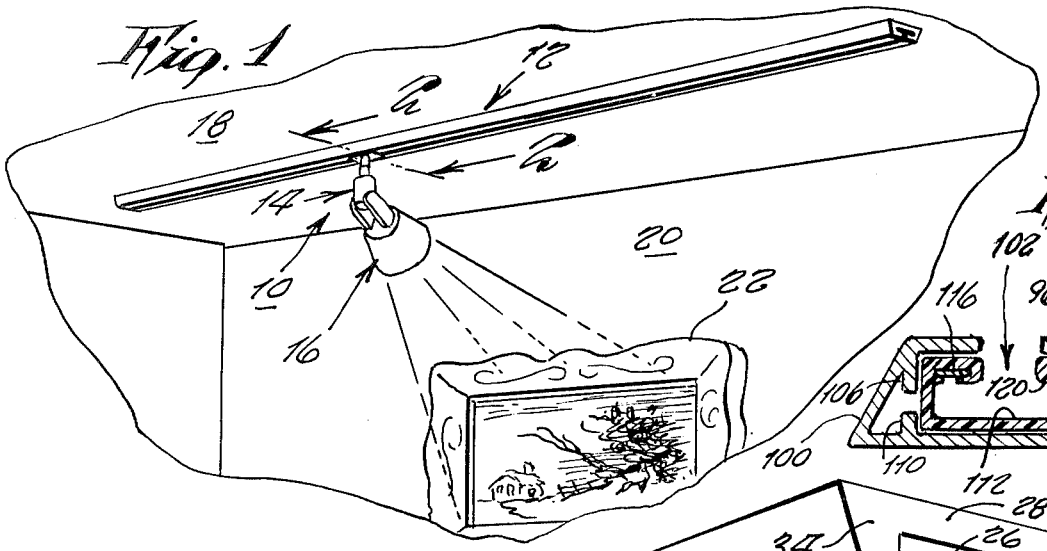
FIG. 1 is a pictorial presentation of the track light of the present invention in use in a room.

Referring now to FIG. 1, the track light of the present invention is shown generally at 10 and comprises a track 12 on which is positioned an adjustable lighting fixture 14 to which is connected a lamp fixture 16.

The track is shown positioned on a ceiling 18. However, it is understood that it could likewise be positioned against another support surface. The lamp fixture is shown casting its light against the wall 20 and specifically onto a picture 22. The lamp fixture is so arranged as to be pivotable through an arc and can be moved to a diametrically opposed position from that shown in the Figure as well as at intermediate positions.

The adjustable lighting fixture 14 can be easily moved along the entire length of the track and repositioned at any desired location of the track. Furthermore, it can easily be removed from the track and reinstalled at another position or on another track. There are no direct connecting wires between the adjustable lighting fixture and the track thereby facilitating the removal and installation onto the track.

Figure 2:
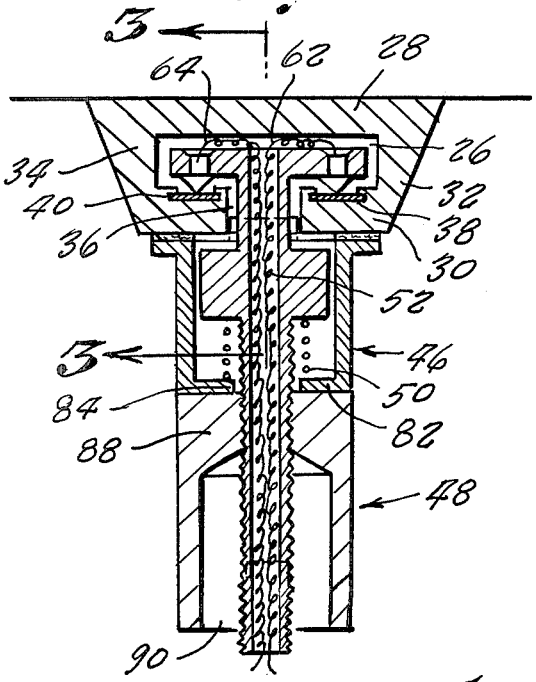
FIG. 2 is a side sectional view of the adjustable lighting fixture locked in position along the track.
Figure 4:
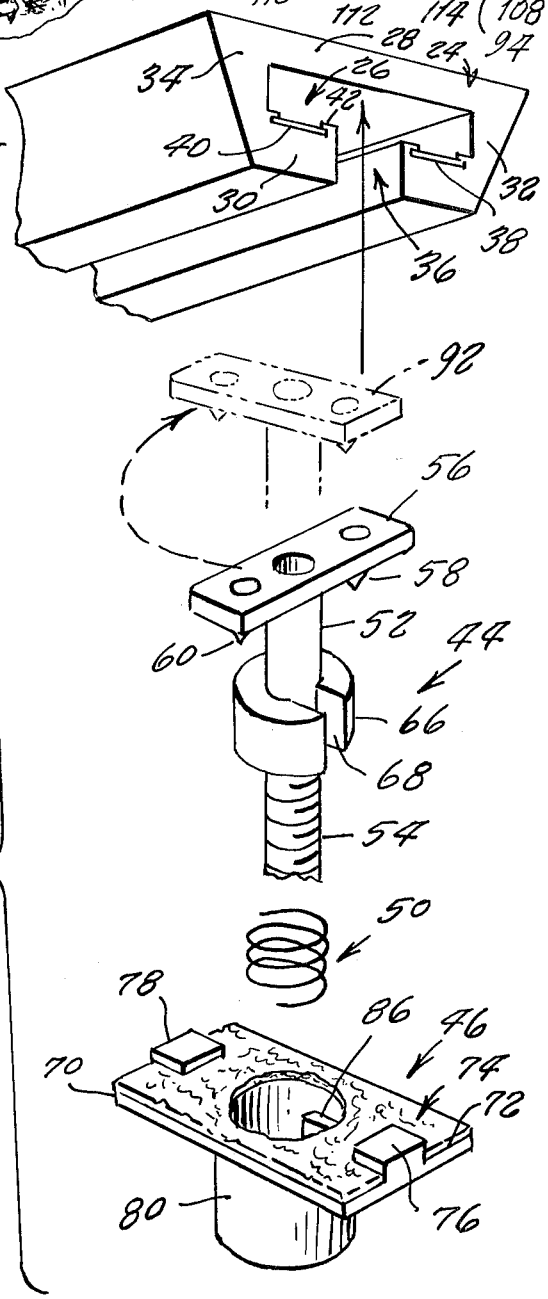
FIG. 4 is an exploded view of the various parts of the track light.
Figure 3:
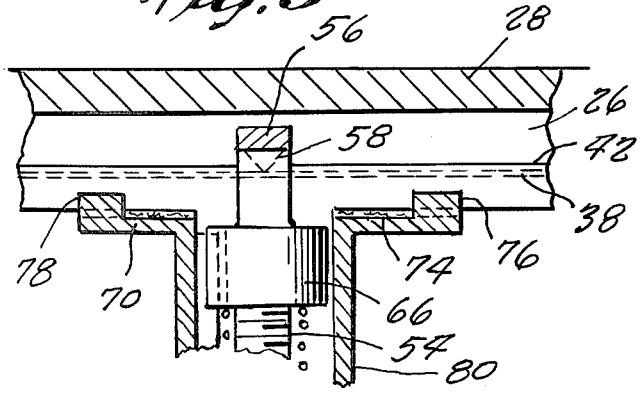
FIG. 3 is a fragmentary sectional view taken along line 3—3 of FIG. 2.

With reference now to FIGS. 2–4, details of the construction of the track light will now be explained. The track itself is comprised of an elongated housing 24, shown by way of example as having a trapezoidal cross section. Formed within the housing is a T-shaped channel which includes the transverse slot 26 bounded by the upper wall 28, the lower wall 30 and the two angled side walls 32 and 34. A groove 36 is formed in the lower wall and provides entry into the slot 26.

Embedded into the lower wall 30 are a pair of laterally spaced parallel conductor strips 38,40, which extend the length of the track. On either edge of the conductor strips there are provided inwardly turned shoulders 42 which overhang the edges of the conductor strip. In this way, the conductor strips are recessed below the surface of the lower wall 30. As a result, should one insert a metal object into the open groove 36, it would not be able to contact the conductor strip because of the shoulders and the recessed positioning of the conductor strips. This avoids the possibility of getting a shock or shorting out the electrical fixture.

The adjustable lighting fixture comprises four parts identified as the connecting member 44, the T-shaped cover member 46, the threaded cap member 48, and the spring 50.

The contacting member includes a hollow post 52, having its lower portion externally threaded 54. Across the top of the post is a cross bar 56 of substantially rectangular configuration. The length of the cross bar is slightly less than the transverse width of the channel in the track. The width of the cross bar is slightly less than the width of the open groove in the track.

A pair of conical contacts 58, 60 depend from the cross bar. The contacts extend through the cross bar having their tops countersunk into the upper surface of the cross bar. The contact holes can receive the respectively insulated wires 62, 64, as shown in FIG. 2. The wires pass over the top of the cross bar and down through the hollow portion of the post. It is understood that the wires are mutually insulated from each other as well as the conical contact which are insulated from each other. The cross bar itself can be made of insulating material as can the entire contacting member 44.

Positioned on the post is a collar 66 spaced from the cross bar. An axial key way 68 is formed through the length of the collar. The post is threaded throughout the portion beneath the collar 66.

The T-shaped cover member 46 includes an upper transverse plate 70 having a flat upper surface 72 upon which is placed padding material 74. Upwardly extending from the lateral opposing ends of the transverse plate are locking pads 76, 78. The width of the locking pads is slightly less than the width of the open grooves in the track.

A hollow cylindrical body portion 80 depends from the transverse plate and terminates at its lower end in an inwardly extending flange 82. The inner ends of the flange are spaced apart to define an opening 84 through which the post 52 can freely pass.

An inwardly extending axial key 86 is provided internally of the cylindrical body and mates with the keyway 68 in the collar. The combination of the key and keyway provides non rotative movement of the cover member 46 with respect to the contact member 44 and defines the longitudinal movement therebetween.

The threaded cap member 48 is of substantially cylindrical configuration and includes a large annular upper portion 88 which is threaded to receive the externally threaded post 52. The lower portion of the cap 48 has a large opening providing a large clearance space between the walls of the cap member and the threaded post.

The spring 50 is placed around the post within the cylindrical body and extends between the lower surface of the collar and the inwardly extending flange at the lower end of the cover member. The spring biases the cover member in a direction away from the cross bar 56.

When assembled, the spring is first placed over the post beneath the collar. The T-shaped cover member is then placed over the post and the key aligned in the keyway. The threaded cap is then threaded onto the post and until it abuts against the lower flange portion of the T-shaped cover member. As the cap member is tightened onto the post, it moves the cover member axially toward the cross bar. With the T-shaped cover member spaced from the cross bar, the cross bar is inserted in the open groove as shown in the dotted line 92 in FIG. 4. The cross bar is then rotated in the channel until it assumes a position extending transversely across the width of the channel. Since the cover member is keyed to the contacting member, it will rotate along the with the rotation of the contact member and now be in a position where the locking pads 76, 78 are aligned with the open groove 36 in the track. The threaded cap member can then be tightened onto the post bringing the cover member upward against the lower portion of the track with the locking pad 76, 78 entering into the groove. The locking pads will then prevent rotation of the lighting fixture in the track. At the same time upon tightening the cap, the conical contacts will be placed into firm contact with the conductor strips in the track.

In order to complete the electrical circuit, at one end of the track the conductor strips can be connected to electric wires which in turn can be plugged into an outlet. Alternately, an opening can be made directly into the ceiling above a portion of the track and electrical contact be made directly with an electric box inserted into the ceiling.

The wires depending from the lower end of the post can be connected to a lamp fixture. The threaded post itself can extend downwardly beneath the cap, as shown in FIG. 3, whereby the post can be utilized for threading onto it of the lamp fixture itself. Furthermore, the lamp fixture housing can enter into the open space 90 provided in the threaded cap member. The lamp fixture can be rotated through an arc of approximately 180° permitting further flexibility and manipulation of the directing of the light. As shown in the FIGS. 2–4, the elongated housing 24 forming the track is of a single unitary material. Such material would typically be of insulating material to prevent short circuiting between the conductor strips embedded therein. For example, it could be made of an extruded plastic material.

Figure 5:
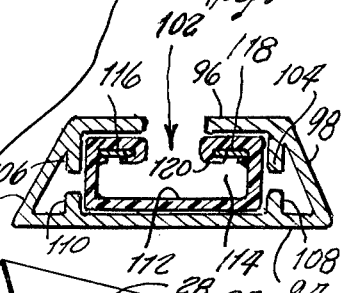
FIG. 5 is a side sectional view of an alternate embodiment of the track.

Alternately, as shown in FIG. 5, the track can be formed of a metallic material having a trapezoidal cross sectional area including the lower wall 94, the upper wall 96, and the two angular side walls 98, 100. An opening 102 is formed in the upper wall 96. Ribs 104, 106, depend from the top wall and mating ribs 108, 110 respectively extend upward from the lower wall 94. The ribs provide reinforcement and also define an inside cross sectional rectangular area. An inner liner 112 of substantially rectangular cross sectional area is formed of insulated material and is positioned within the space defined by the ribs. The liner provides for the T-shaped channel including the transverse slot 114 and the groove which corresponds with the opening 102. The conductor strips 116, 118 are embedded into the liner and the shoulders 120 overhang the edges of the conductor strips.

Utilizing the embodiment shown in FIG. 5, the housing can be extruded and the inner sleeve can be separately extruded and inserted within the outer housing.

The overhanging shoulders can be formed integral with the wall in which the conductor strips are embedded.

As shown in FIG. 3, the external diameter of both the threaded cap 48 and the cover 46 are substantially the same size whereby the adjustable lighting fixture will give the appearance of a single unitary member. Furthermore, the contacting member including the post, cross bar and collar can all be formed of single unitary material. The lower tips of the conical contacts can be slightly flattened in order to provide a better contacting surface onto the conductor strips.

There has been disclosed heretofore the best embodiments of the invention presently contemplated. However, it is to be understood and various changes and modifications may be made thereto without departing from the spirit of the invention.

I claim:

1. A track light comprising, in combination:

(a) a track including:

(1) an elongated housing for mounting onto a support surface;

(2) a T-shaped channel formed in said housing and having a transverse slot with a lower wall and an open groove formed in said lower wall;

(3) a pair of laterally spaced, parallel conductor strips, partially embedded into said lower wall on opposite sides of said groove; and (4) inwardly turned shoulders formed in said lower wall and overhanging the edges of said conductor strips; and (b) an adjustable lighting fixture, including:

(1) a contacting member having a hollow post externally threaded on at least a portion thereof, a cross bar connected across one end of the post having a length less than the width of said channel and a width less than the width of said groove, a pair of mutually insulated conical contacts depending from said cross bar and laterally spaced on either side of said post for separably engaging a respective conductor strip, and an axial collar coupled to said post in spaced relationship from said cross bar with an axial keyway formed in said collar;

(2) a T-shaped cover member having a transverse plate with a cylindrical body depending therefrom, an inwardly turned radial flange at the lower end of said cylindrical body defining a central opening through which said shaft can extend, an axial key inwardly extending from said cylindrical body and mating with said keyway for non-rotative engagement with said contacting member, locking pads upwardly extending from said transverse plate and laterally positioned with respect to said cylindrical body for extending into said groove to prevent rotation of said T-shaped cover member with respect to said track;

(3) a threaded cap member threading onto said post axially outward of said cover member for axially moving said cover member along said post, and (4) a spring spacedly positioned around said post within said cylindrical body and extending between said collar and said flange for biasing said cover member away from said cross bar to permit insertion of said cross bar through said groove and then upon rotation, into said channel, whereupon said cap member can tighten said lighting fixture onto said track with said locking pads in said groove and said conical contact firmly contacting said conductor strips.

2. A track light as in claim 1, wherein said elongated housing is formed of insulative material, and said inwardly turned shoulders are integrally formed with said lower wall.

3. A track light as in claim 1, wherein said elongated housing comprises an outer shell formed of metallic material, an elongated channel formed in said outer shell, and an insulative inner liner extending in said elongated channel, said inwardly turned shoulders being integrally formed with said inner liner.

4. A track light as in claim 1, and further comprising padding means covering the upper surface of said transverse plate to provide a cushioning between said lighting fixture and said track.

5. A track light as in claim 1 and further comprising electrical wires extending through the hollow post and across the cross bar, a wire being respectively connected to each of said conical contacts.

6. A track light as in claim 1, wherein said post is threaded throughout the portion beneath the collar.

7. A track light as in claim 1, wherein the length of said post is such as to extend entirely through both said T-shaped cover member and said threaded cap member.

8. A track light as in claim 1, wherein both said T-shaped cover member and said threaded cap member comprise abutting cylindrical body portions of substantially the same outer dimension.

* * * * *